US007059561B2

(12) United States Patent
Trouillot

(10) Patent No.: US 7,059,561 B2
(45) Date of Patent: Jun. 13, 2006

(54) DEPLOYMENT DEVICE FOR A FIN

(75) Inventor: Christian Trouillot, Morthomiers (FR)

(73) Assignee: GIAT Industries, Versailles (FR)

( * ) Notice: Subject to any disclaimer, the term of this patent is extended or adjusted under 35 U.S.C. 154(b) by 0 days.

(21) Appl. No.: 10/950,502

(22) Filed: Sep. 28, 2004

(65) Prior Publication Data

US 2005/0082420 A1 Apr. 21, 2005

(30) Foreign Application Priority Data

Oct. 6, 2003 (FR) ..... 03 11642

(51) Int. Cl.
*B64C 5/12* (2006.01)

(52) U.S. Cl. ..... 244/3.28; 244/3.29; 244/49

(58) Field of Classification Search ..... 244/49, 244/3.24–3.3; 102/473, 520
See application file for complete search history.

(56) References Cited

U.S. PATENT DOCUMENTS 3,063,375 A * 11/1962 Hawley et al. ..... 244/3.27
4,323,208 A * 4/1982 Ball ..... 244/3.28
4,664,339 A * 5/1987 Crossfield ..... 244/3.28
4,728,058 A 3/1988 Brieseck et al. ..... 244/3.28
4,869,442 A * 9/1989 Miller ..... 244/3.28
5,480,111 A * 1/1996 Smith et al. ..... 244/3.27
5,584,448 A 12/1996 Epstein et al. ..... 244/3.28
5,762,294 A 6/1998 Jimmerson ..... 244/49
2004/0144888 A1 * 7/2004 Dryer et al. ..... 244/3.27

FOREIGN PATENT DOCUMENTS

DE 30 10 027 9/1981
FR 2 797 946 3/2001

* cited by examiner

*Primary Examiner*—Galen Barefoot
(74) *Attorney, Agent, or Firm*—Steptoe & Johnson LLP

(57) ABSTRACT

A deployment device for a fin of a projectile incorporating a hinge fixed to the projectile body which allows said fin to make a pivoting movement along at least one axis, wherein said hinge comprises a support for said fin mounted able to tilt over with respect to an axis substantially perpendicular to the projectile axis, said fin being linked to said support by a rod whose axis is substantially parallel to said projectile axis when said fin is in the folded position and substantially perpendicular to said projectile axis when said fin is in the deployed position, said rod itself being able to pivot with respect to said fin support when such said support tilts over, this pivoting of said rod being controlled by driving means.

9 Claims, 4 Drawing Sheets

DEPLOYMENT DEVICE FOR A FIN

BACKGROUND OF THE INVENTION

1. Field of the Invention

The technical scope of the invention is that of deployable fins fitted onto projectiles.

2. Description of the Related Art

Projectile fins generally have a stabilizing role. They are grouped at a rear part of the projectile to form a tailpiece.

Certain projectiles have other fins whose role is that of guidance. These fins are generally placed at the front part of the projectile.

For reasons of their overall bulk and so as to enable firing from a gun barrel, the fins must be folded either backwards or forwards along the projectile, or inside it, before firing.

They must deploy upon exiting the gun barrel to ensure fulfill their stabilizing or guidance role.

Different solutions have been proposed to ensure this deployment function.

Patent FR2623898 thus describes a deployment device in which the fins are organized along an external wall of the projectile. Each fin is firstly driven by a back-geared motor which makes it pivot around an axis perpendicular to the plane of the fin.

Thereafter, it is made to pivot by the aerodynamic effect around an axis parallel to the plane of the fin.

This deployment mechanism is slow, which is why it is better suited to projectiles such as scatterable submunitions. Moreover, it requires the use of a back-geared motor for each fin. These motors are costly and occupy a considerable volume inside the projectile. The employment of such a mechanism is thus limited to intelligent sub-munitions in which the motors are moreover essential to ensure a guidance function after deployment.

Such a mechanism can not be envisaged for a projectile fired from a cannon and for which the deployment of the fins must be made immediately upon exiting the barrel in order to ensure the stabilization of the projectile and must use a minimum amount of space inside the projectile.

SUMMARY OF THE INVENTION

It is the purpose of the invention to propose a fin-deploying device that is simple in design, does not require on-board power and which ensures the quick and reliable deployment of the fins, by aerodynamic flow effect, whilst limiting the intrusion of the fins in the projectile.

Thus, the invention relates to a fin-deploying device for a projectile, comprising a hinge fixed to the projectile body which allows the fin to make a pivoting movement along at least one axis, device wherein the hinge comprises a support for the fin mounted able to tilt over with respect to an axis substantially perpendicular to the projectile axis, the fin being linked to the support by a rod whose axis is substantially parallel to the projectile axis when the fin is in the folded position and substantially perpendicular to the projectile axis when the fin is in the deployed position, the rod itself being able to pivot with respect to the fin support when such support tilts over, this pivoting of the rod being controlled by driving means.

According to another characteristic of the invention, the fin's rod is able to translate with respect to the support and the rod has, in addition, a head in contact with a first cam profile that is fixed and integral with the projectile body, spring means being positioned between the head and the support so as to control the initial opening of the fin by the tilting of the support.

According to a first embodiment of the invention, the fin's rod head incorporates an arm substantially perpendicular to the rod and cooperating with a second cam profile that is fixed and integral with the projectile body, both arm and second cam profile forming the driving means making the rod pivot, the tilting of the fin support with respect to the body also causing the rod to pivot with respect to the support.

Advantageously, the second cam profile may be extended by a groove in which the arm is housed when the rod has pivoted of around 90°, such groove then ensuring the immobilization in rotation of the rod with respect to the support.

According to another embodiment of the invention, the support incorporates at least one helicoidal opening in which a pin slides that is integral with the rod and transversal to it, the pin and opening forming driving means to make the rod pivot, the translation of the rod with respect to the support thus causing, by the action of the pin in the opening, a rotation of the rod with respect to the support.

According to another embodiment of the invention, the support incorporates a screw hole cooperating with threading on the rod, both screw hole and threading forming the driving means that make the rod pivot, the translation of the rod with respect to the support thus causing, by the cooperation of the threading with the screw hole, a rotation of the rod with respect to the support.

The rod head may incorporate one end that is introduced into an opening of matching shape when the fin is in its deployed position, thereby ensuring the locking of the deployed fin with respect to the projectile.

The rod may be fastened to the fin at a distance from a median axis dividing the plane of the fin into two, such that the aerodynamic flow received by the fin also creates a torque able to drive the rod in rotation.

The fin may comprise a heel cooperating, when in the deployed position, with a groove.

BRIEF DESCRIPTION OF THE DRAWINGS

The invention will become more apparent from the following description made of the different embodiments, such description made with reference to the appended drawings, in which.

DETAILED DESCRIPTION OF PREFERRED EMBODIMENTS

Figure 1A:
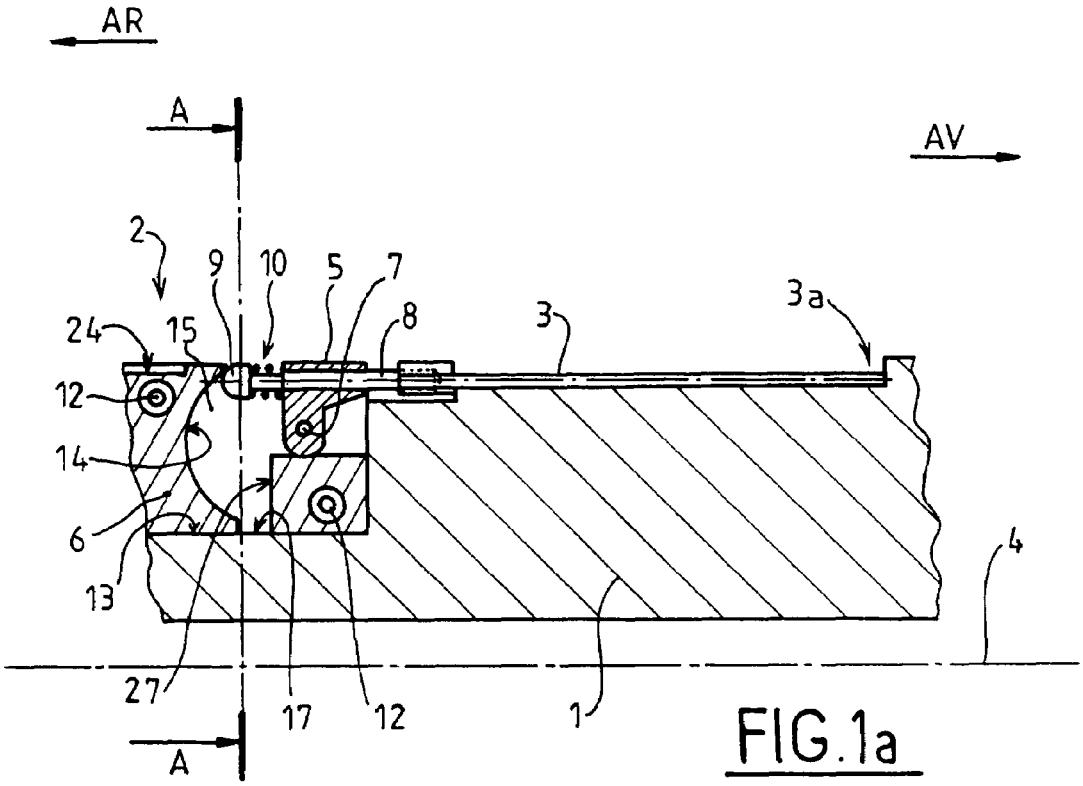
FIGS. 1*a* and 1*b* show an embodiment of the invention in the position where the fins are folded, FIG. 1*a* being a partial section of the projectile made at a fin and FIG. 1*b* being a partial cross section made along the plane marked AA in FIG. 1*a,*

FIG. 1*a* shows a partial longitudinal section of a rear part of a projectile 1. The section is made at a deployment device 2 for a stabilizing fin 3. The projectile is generally fitted with 3 to 8 identical stabilizing fins which all have identical deployment devices.

Here, the fin 3 is folded along the projectile body 1. The plane of the fin is thus positioned along a projectile wall and is oriented substantially in parallel to the axis 4 of the projectile.

The external end 3*a* of the fin is oriented towards the front part (reference AV) of the projectile, and a shearable retention device (such as a polyamide ring, not shown) will be advantageously provided at this extern end 3*a*.

The external end 3*a* of the fin may receive an additional device allowing the opening of the fin to be started by the effect of the aerodynamic flow, for example a detachable blade. Such a blade forms the subject of patent FR2721702. It is thus unnecessary to describe it in further detail.

According to the invention, the fin deployment device incorporates a hinge, fixed to the projectile body, and comprising a fin support 5 mounted able to tilt with respect to a casing 6 integral with the projectile body 1.

The support 5 of the fin 3 may thus tilt over with respect to an axis 7 that is substantially perpendicular (in projection) to the axis 4 of the projectile.

The fin 3 is linked to its support 5 by a rod 8 whose axis is parallel to the fin plane, and thus substantially parallel to the axis 4 of the projectile when the fin is in its folded position.

The axis of the rod 8 will be substantially perpendicular to the projectile axis when the fin is in the deployed position or else, according to the stabilization requirements, it may be inclined rearwards (towards reference AR) of the projectile by a locking angle (this so-called tail-setting angle being normally of between 0° and 45°).

The rod 8 is mounted able to pivot with respect to the support 5 of the fin 3 and may also translate with respect to the support 5.

At its end, the rod 8 has an enlarged head 9 held in contact with the casing 6 by a spring 10.

The spring 10 is mounted on the rod 8 and is placed between the enlarged head 9 and the support 5.

As may be more particularly seen in FIGS. 2*a* and 3*a*, the enlarged head 9 incorporates a lateral arm 11, substantially perpendicular to the rod 8, such arm whose function will be described hereafter.

The casing 6 is housed in a radial notch 13 in the projectile body. It is made integral with it by appropriate joining means, such as screws, not shown, or a rear flange. If the tailpiece is required to be separated during rotation from the projectile, the casing 6 may be fastened to a ring mounted free to rotate with respect to the projectile, for example using ball bearings.

The casing 6 is closed by a cover 6*a* (FIG. 3) fastened by screws 12 (FIG. 1*a*). The pivot axis 7 of the support 5 is mounted between the casing 6 and the cover 6*a*.

The casing 6 carries a first concave cam profile 14 that pilots the tilting of the fin support 5 and onto which the head 9 is applied by the spring 10. This cam will hereafter be termed tilting cam.

The load exerted by the spring 10 associated with the profile of the tilting cam thus causes the head 9 to slide on the cam profile 14 thereby causing the support 5 to tilt, and thus the initial opening of the fin 3.

This movement caused by the spring 10 is sufficient to ensure the initial opening of the fin, but may be reinforced by an aerodynamic blade fastened at the end 3*a* of the fin.

The casing 6 also carries a second convex cam profile 15, which pilots the tilting of the rod 8 of the fin, profile onto which the arm 11 of the head 9 presses. This cam will hereafter be termed pivoting cam.

This second cam profile 15 determines the pivoting phase (onset, speed) of the rod 8 with respect to the support 5 of the fin 3 during the tilting movement of the support 5 with respect to the casing 6.

It also allows the incidence of the fin to be determined in the open position thereby allowing the projectile to be turned if necessary.

Figure 2A:
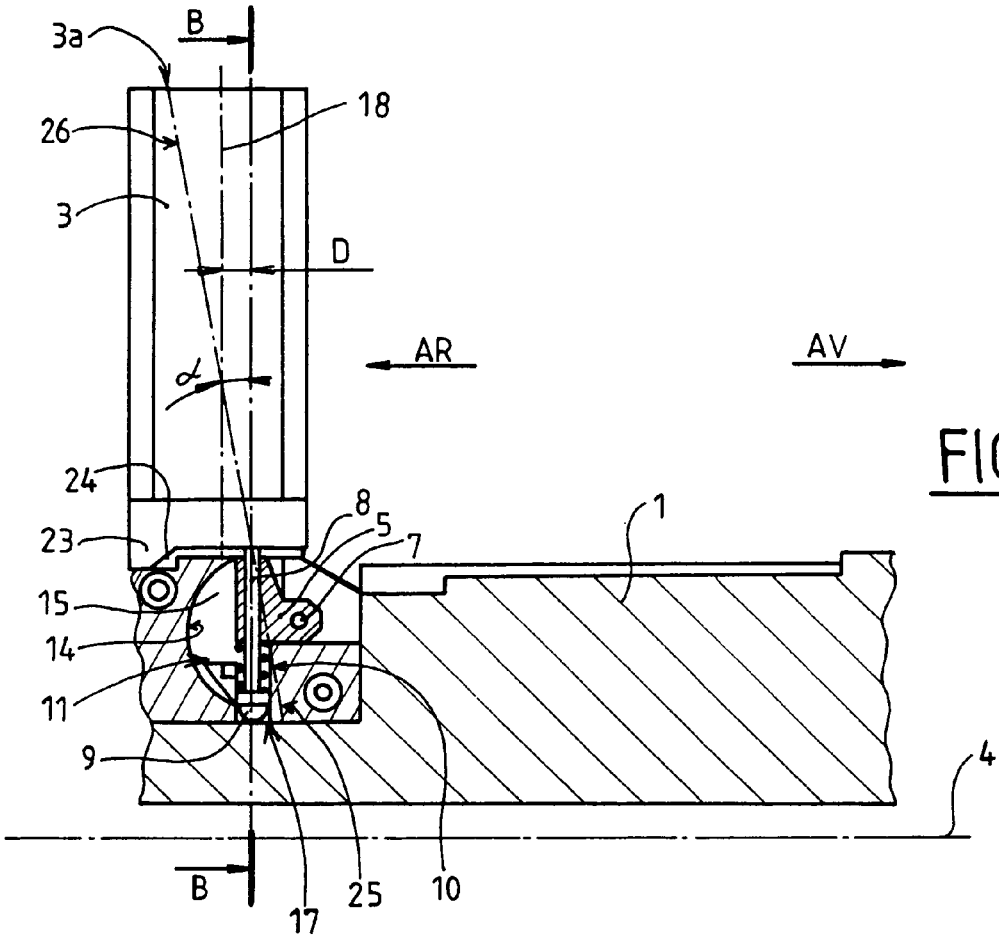
FIGS. 2*a* and 2*b* are views of the same device, with the fins deployed, FIG. 2*a* being a partial cross section made along the plane marked BB in FIG. 2*a,*
Figure 2B:
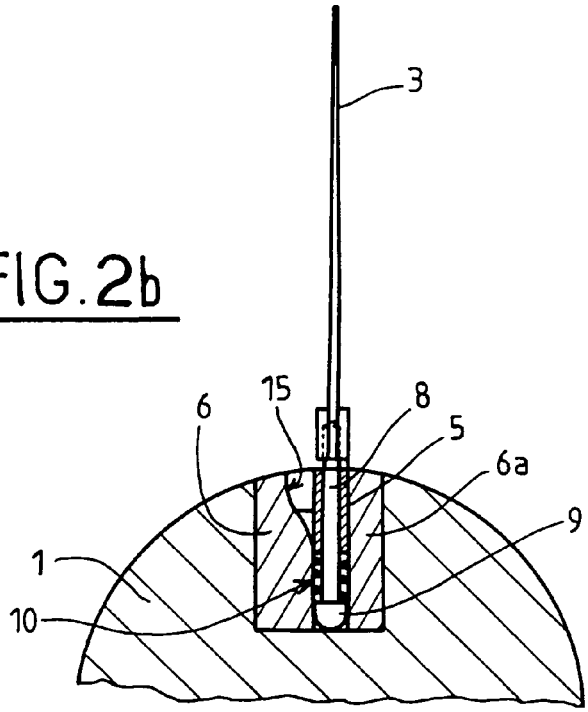

FIGS. 2*a* and 2*b* show the device in the deployed fin position.

The tilting of the fin support 5 around the axis 7, thanks to the cooperation of the arm 11 and the second cam profile 15, has concomitantly caused the fin to pivot with respect to the support 5.

The plane of the fin 3 is thus oriented radially with respect to the projectile and the rod 8 carrying the fin is thus substantially perpendicular to the projectile's axis 4.

Figure 3:
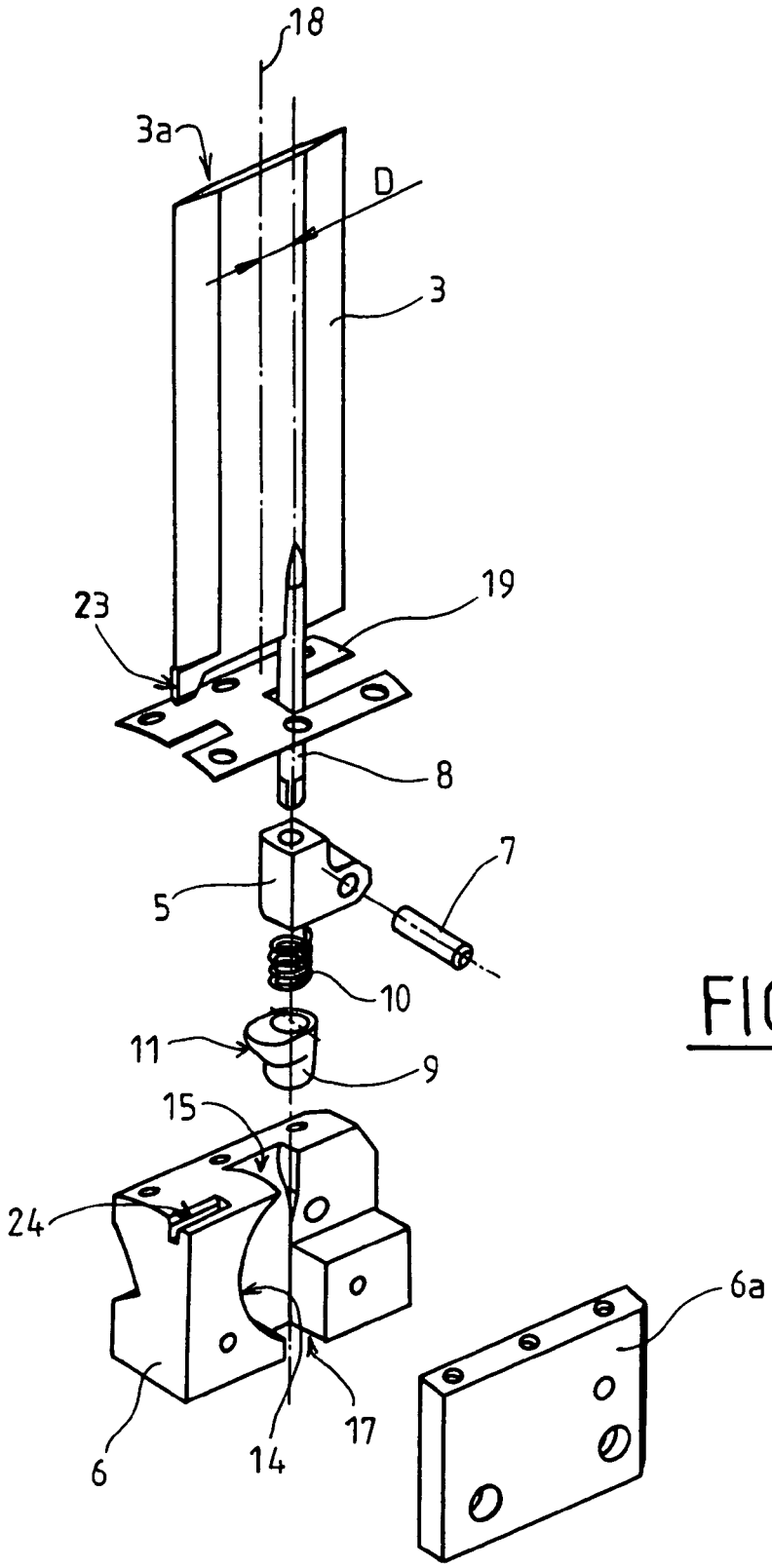
FIG. 3 is an exploded view of the assembly of this device.

The fin 3 is locked in place by its heel 23 arranged at the trailing edge and which penetrates inside a groove 24 in the casing 6 (see also FIG. 3).

Figure 4:
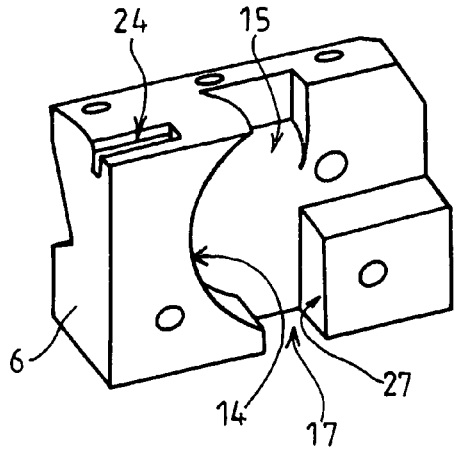
FIG. 4 is a perspective view of the casing carrying the cam profiles.

The adjustment of the deflection of the fin is carried out merely by acting on the orientation of the abutment surface 27 of the head 9 on the casing 6 (see FIGS. 1*a* and 4).

The deployment device shown in the Figures shows a fin with no deflection. The dashed lines 25 in FIG. 2*a* show a different orientation for the abutment surface 27. This inclined abutment would allow the axis of the rod 8 carrying the fin to be oriented in the direction 26 which corresponds for fin 3 to a deflection $\alpha$ oriented to the rear (AR) of the projectile.

Figure 1B:
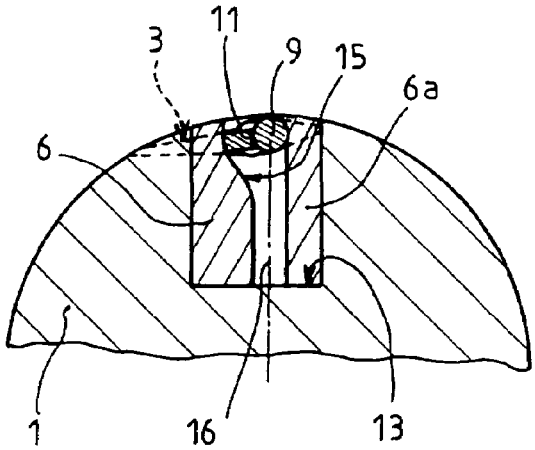

As may be more particularly seen from FIG. 1*b*, casing 6 incorporates an internal groove 16 that extends the pivoting cam 15. The groove 16 is delimited by the cover 6*a*, by a wall 6*b* of the casing parallel to the cover 6*a* and by the first cam profile 14.

The arm 11 of the head 9 is housed in this groove 16 after the fin 3 has been deployed (see FIG. 2*a* and 2*b*).

The groove 16 thus ensures the immobilization in rotation of the rod 8 with respect to the support 5.

The casing 6 will be defined such that this immobilization occurs when the rod 8 has pivoted by the deflection angle required, that is to say, in the example shown in the Figures, by around 90° with respect to the support 5.

Moreover, the groove 16, which is also delimited by the tilting cam profile 14, is extended at the end of the latter by an opening 17 (see FIG. 1*a*).

When the fin is completely deployed, the head 9 of the rod 8 is introduced into this opening 17, which has an appropriate diameter (see FIG. 2*a*). The opening 17 thus ensures the locking of the fin 3 in its deployed position with respect to the projectile 1. The depth of the opening 17 also allows the final position of the fin 3 to be adjusted in height with respect to the projectile body 1.

As may be more particularly seen from FIGS. 2*a* and 3, the rod 8 is fastened to the fin 3 at a distance D from a median axis 18 dividing the plane of the fin into two.

When the pivoting axis of the fin is thus offset towards the leading edge, the aerodynamic flow received by the fin at the onset of its opening phase creates a torque whose effect is to drive the rod 8 in rotation with respect to the support 5. This aerodynamically generated torque combines with the mechanically generated torque created by the arm 11 cooperating with the second cam profile 15. The offset D of the pivoting axis also allows the fin to be pivoted earlier without the risk of its coming into contact with the projectile body. FIG. 3 also shows, by way of illustration, a hood 19 closing the upper part of the casing 6 and recreating the aerodynamic profile of the projectile body. This hood is not shown in the other Figures.

We see that the invention, using an extremely simple mechanical structure, ensures the complicated deployment movement of a projectile's stabilizing fin.

The aerodynamic action alone of the flow on the fin, once this has been slightly pushed away from the body (thanks to a spring 10 associated with the tilting cam profile 14) ensures firstly the tilting of the fin with respect to the projectile body, and secondly the pivoting of the fin around the axis of its rod. When fully opened, the fin is locked along its two planes, by the combined action of the head 9 and the arm 11. Locking at incidence is reinforced by the presence of the heel 23 at the trailing edge, this heel also being effective in avoiding any twisting of the fin.

This deployment device occupies a reduced inner volume in the projectile body. The fin planes remain outside the body. The fin housings may be adjusted to the dimensions of the fins, which are thus correctly held in position during the cannon phase and protected from aggression by the propellant gases.

By way of a variant, it is possible for a deployment device to be defined in which the structure of the driving means ensuring the pivoting of the rod 8 with respect to the fin support 5 is different.

Figure 5:
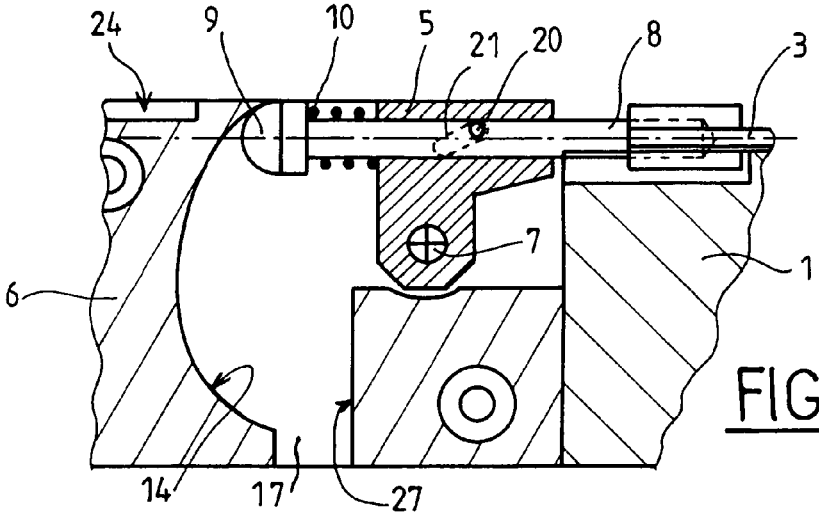
FIG. 5 is a partial view, fin folded, of a variant embodiment of the device according to the invention.

By way of example, FIG. 5 thus shows another embodiment that differs from the previous one in that the head 9 extending the rod 8 of the fin 3 has no arms 11. Moreover, the casing 6 does not incorporate a second convex cam profile 15.

The principle of the fin tilting remains unchanged, however, its pivoting is ensured by different driving means. The driving means are constituted here by a pin 20 integral with the rod 8 and transversal to it. This pin 20 circulates in an opening 21, arranged in the support 5 and having a helicoidal profile.

The translation of the rod 8 with respect to the support 5 thus also causes a rotation of the rod with respect to the support 5. Indeed, the rod 8 is only able to translate by following the helicoidal profile 21 guiding the pin 20.

The helical pitch will easily be chosen by some one skilled in the art such that the rod pivots 90° with respect to the support 5 when said support has itself pivoted 90° with respect to its axis 7.

Figure 6:
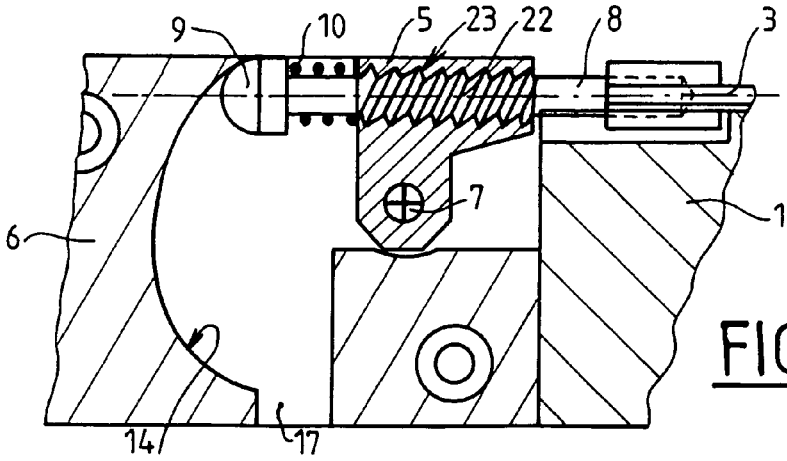
FIG. 6 is a partial view, fin folded, of another variant embodiment of the device according to the invention.

It is also possible for the pin 20 and the helicoidal opening 21 to be replaced, as shown in FIG. 6, by a threading 22 at an appropriate pitch made on the rod 8 and cooperating with a screw hole 23 made in the support 5.

What is claimed is:

1. A deployment device for a fin of a projectile, comprising:

a hinge fixed to a projectile body to and a fin, which permits said fin to make a pivoting movement to tilt over with respect to an axis substantially perpendicular to the projectile axis, said hinge also comprises a support for said fin, said fin being linked to said support hinge by a rod whose axis is substantially parallel to said projectile axis when said fin is in the folded position and substantially perpendicular to said projectile axis when said fin is in the deployed position, said rod being able to pivot with respect to said fin support when said support tilts over, such pivoting of said rod being controlled by driving means.

2. A deployment device according to claim 1, wherein said rod of said fin is able to translate with respect to said support, and said rod has a head in contact with a first cam profile that is fixed and integral with said projectile body, spring means positioned between said head and said support to control initial opening of said fin by tilting of said support.

3. A deployment device according to claim 2, wherein said head of said rod comprises an arm substantially perpendicular to said rod and cooperating with a second cam profile that is fixed and integral with said projectile body, both said arm and said second cam profile forming said driving means for making said rod pivot, the tilting of said fin support with respect to said body also causing said rod to pivot with respect to said support.

4. A deployment device according to claim 3, wherein said second cam profile is extended by a groove in which said arm is housed when said rod has pivoted 90°, said groove ensuring immobilization in rotation of said rod with respect to said support.

5. A deployment device according to claim 2, wherein said support comprises at least one helicoidal opening in which a pin slides said pin being integral with said rod and transverse to it, said pin and said opening forming driving means to make said rod pivot, the translation of said rod with respect to said support causing, by the action of said pin in the opening, a rotation of said rod with respect to said support.

6. A deployment device according to claim 2, wherein said support comprises a screw hole cooperating with threading on said rod, both said screw hole and said threading forming said driving means to make said rod pivot, translation of said rod with respect to said support causing, by the cooperation of said threading with said screw hole, a rotation of said rod with respect to said support.

7. A deployment device according to claim 2, wherein said head end of said rod is located in an opening of matching shape when said fin is in its deployed position, thereby ensuring the locking of said deployed fin with respect to said projectile.

8. A deployment device according to claim 1, wherein said rod is fastened to said fin at a distance (D) from a median axis dividing in half the plane of said fin, such that the aerodynamic flow received by said fin creates a torque able to drive said rod in rotation.

9. A deployment device according to claim 1, wherein said fin has a heel cooperating, when in the deployed position, with a groove.

* * * * *